US007584779B2

(12) United States Patent
Nakayama et al.

(10) Patent No.: US 7,584,779 B2
(45) Date of Patent: Sep. 8, 2009

(54) TWIN ROLL CASTING MACHINE

(75) Inventors: Katsumi Nakayama, Tokyo (JP); Toshiro Matsushita, Tokyo (JP); Hisahiko Fukase, Tokyo (JP)

(73) Assignee: Castrip, LLC, Charlotte, NC (US)

( * ) Notice: Subject to any disclaimer, the term of this patent is extended or adjusted under 35 U.S.C. 154(b) by 138 days.

(21) Appl. No.: 11/627,118

(22) Filed: Jan. 25, 2007

(65) Prior Publication Data

US 2007/0169914 A1 Jul. 26, 2007

(30) Foreign Application Priority Data

Jan. 26, 2006 (JP) ..... 2006-017531

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

| | | | | |
|---|---|---|---|---|
| 4,671,340 | A * | 6/1987 | Larrecq et al. | 164/429 |
| 4,883,369 | A | 11/1989 | Jude et al. | |
| 5,626,183 | A | 5/1997 | Romanowski et al. | |
| 6,167,942 | B1 | 1/2001 | Fish et al. | |
| 6,167,943 | B1 | 1/2001 | Fish et al. | |
| 6,397,924 | B1 * | 6/2002 | Fish et al. | 164/480 |
| 6,453,986 | B1 | 9/2002 | Leabeater et al. | |
| 6,536,506 | B2 | 3/2003 | Nikolovski | |
| 6,837,301 | B2 | 1/2005 | Nikolovski et al. | |
| 6,883,585 | B2 * | 4/2005 | Poloni et al. | 164/480 |
| 7,100,673 | B2 | 9/2006 | Botham et al. | |

FOREIGN PATENT DOCUMENTS

| | | |
|---|---|---|
| EP | 244257 | 9/1990 |
| JP | 2000-000643 | 1/2000 |
| JP | 2001-009557 | 1/2001 |

OTHER PUBLICATIONS

PCT/AU2007/000070 International Search Report.
PCT/AU2007/000070 Written Opinion.

* cited by examiner

*Primary Examiner*—Kuang Lin
(74) *Attorney, Agent, or Firm*—Hahn Loeser & Parks LLP

(57) ABSTRACT

A twin roll casting machine and method of continuously casting thin strip that enables the manufacture of thin strip by applying a thrust force through casting roll support structures on each casting roll to bias the casting rolls together, such that a majority portion of the thrust force counterbalances ferro-static pressure. Cooling water is caused to flow through rotary joints (10) that are attached to one or both of the ends of casting rolls (1). The rotary joints at each casting roll cause cooling water to flow into and from the passages in the casting rolls and exert forces on the casting rolls generally in the direction along the rotational axis of the casting rolls.

35 Claims, 6 Drawing Sheets

TWIN ROLL CASTING MACHINE

BACKGROUND AND SUMMARY OF THE INVENTION

This application claims priority to Japanese Patent Application 2006-017531 filed on Jan. 26, 2006, hereby incorporated by reference.

The present invention relates to a twin roll casting machine.

It is known to cast steel strip by continuous casting in a twin roll caster. In this technique molten metal is introduced between a pair of counter-rotated horizontal casting rolls, which are cooled so that metal shells solidify on the moving roll surfaces, and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip, for forming a casting pool of molten metal supported on the casting surfaces of the rolls above the nip and extending along the length of the casting rolls. This casting pool is usually confined between side plates or dams held in sliding engagement adjacent the ends of the casting rolls so as to restrict the casting pool against outflow.

FIG. 5 and FIG. 6 illustrate an example of a known twin roll type casting machine. The machine comprises a pair of water-cooled casting rolls 1 positioned laterally to form a roll nip G between them, and a pair of side plates 2 engage the ends of the casting rolls 1.

The direction and speed of rotation of the counter-rotating casting rolls 1 are set so that the outer circumferential surfaces of the casting rolls move from above towards the roll nip G. One of the side plates 2 is in contact with the ends of the two casting rolls 1 at one end of the rolls, and the other of the side plates 2 is in contact with the ends of the two casting rolls 1 at the other end of the rolls 1. A molten metal delivery nozzle 4 made from a refractory material is positioned above the roll nip G in a space enclosed by the casting rolls 1 and the side plates 2.

The molten metal delivery nozzle 4 comprises side walls and end walls that define an upwardly opening elongated trough 6 for receiving molten metal 5 and a plurality of outlet openings 7 for outflow of molten metal from the trough 6. The openings 7 are formed in a lower section of the side walls of the nozzle 4 to direct molten metal from the trough 6 towards the outer circumferential surfaces of the casting rolls 1. With this arrangement, molten metal 5 poured into the trough 6 flows outwardly through the openings 7 and forms a casting pool of molten metal 8 in contact with the outer circumferential surfaces of the casting rolls 1 over the roll nip G.

When the casting pool 8 is formed and the casting rolls 1 are rotating with cooling water flowing through and extracting heat from the rolls 1, molten metal 5 solidifies at the outer circumferential surfaces of the casting rolls 1 and forms solidified shells. A downwardly moving strip 3 is formed by the solidified shells coming together at the roll nip G.

The spacing between the casting rolls 1 at the roll nip G is maintained by horizontally acting thrust forces F that are applied to roll end support structures (not shown) that support the ends of the casting rolls 1 to bring them together to form a strip 3 of a desired thickness delivered downwardly from the roll nip G.

The thrust forces F are selected to be sufficient to counter (a) the ferrostatic pressure that acts on the casting rolls 1 through the molten metal 5 in the casting pool 8, (b) friction between the movable casting roll or rolls 1 and a guide assembly that supports the roll(s) for horizontal movement towards or away from each other, and (c) unbalanced "rogue" forces acting on the casting rolls 1.

The unbalanced "rogue" forces may be caused by a number of factors, including (a) a non-uniform distribution of the mass of the casting rolls 1, including the auxiliary parts, such as rotary joints for supplying cooling water to and removing cooling water from the rolls and so forth and (b) the effects of cooling water flowing into, through, and from the casting rolls 1. However, unbalanced rogue forces are undesirable from the viewpoint of process control and product quality. Moreover, increasing thrust forces F may not always compensate for adverse effects of rogue forces.

The ferrostatic pressure that acts on the casting rolls 1 through the molten metal 5 in the casting pool 8 is determined by factors, including the diameter of the casting rolls, the length of the roll bodies of the casting rolls 1, the height of the casting pool 8, the speed of rotation of the casting rolls 1, and the composition and temperature of the material used to form strip 3.

We have found that a substantial portion of the thrust forces F should be to account for the ferrostatic pressure of the molten metal 5. It can be shown by calculation that, for a ferrostatic pressure generated by a casting pool 8 of mass 150 kg, the total of the thrust forces F required to counter the ferrostatic pressure should be of the order of 150 kg+$\alpha$ (where $\alpha$<10 kg). However, in practice in the past, thrust forces F in excess of 300 kg were required in order to counter the ferrostatic pressure and the other factors mentioned above, such as the weight and pressure of cooling water that, typically, is continuously supplied at a rate of 5 tones per minute at 20 m per second to the casting rolls 1.

The required thrust forces F of 300 kg are excessive and can have an undesirable impact on process control and product quality. For example, the excessive thrust forces, particularly if unbalanced along the length of the casting rolls 1, may generate chatter, which results in irregularities in the thickness of the strip 3 along the length and across the width of the strip 3.

Moreover, a non-uniform distribution of the mass of the casting rolls 1, including the auxiliary parts such as the rotary joints, may cause misalignment of the casting rolls 1 such that there is an undesirable variation in the roll nip G along the length of the casting rolls 1. Typically, in such situations, the roll gap G is wedge-shaped when viewed from above along the casting rolls 1, with a larger gap at one end and a smaller gap at the other end of the rolls 1.

The twin roll casting machine of the present disclosure can reduce unbalanced rogue forces and provide better control to produce better quality product.

A twin roll casting machine is disclosed that comprises:

(a) a pair of water-cooled casting rolls laterally positioned to form a nip therebetween, with the casting rolls biased towards each other by thrust forces, and (b) rotary joints coupled to at least at one end of the casting rolls and capable of supplying cooling water into and removing cooling water out of passages in the casting rolls, with the rotary joints of each casting roll being arranged so that the flow of cooling water into the rotary joints and the flow of cooling water out of the rotary joints exert forces on the casting rolls generally in a direction along the rotational axis of the casting.

The flow of cooling water into and out of the rotary joints may be a vertical direction that is generally perpendicular to a rotational axis of the casting roll. The rotary joints of the casting rolls may be arranged so that the flow of cooling water into the rotary joints is in a generally vertical upward direction orthogonal to the rotational axes of the casting rolls.

The rotary joints may be coupled to both ends of both casting rolls and capable of supplying cooling water into and removing cooling water out of passages in the casting rolls, with the rotary joints of each casting roll being arranged so that the flow of cooling water into the rotary joints and the flow of cooling water out of the rotary joints exert forces on the casting rolls generally in a direction along the rotational axis of the casting.

When the rotary joints are coupled to only one end of the casting rolls, counterweights may be attached to sections of the casting rolls at the other end of the casting rolls that counterbalance the rotary joints.

The twin roll casting machine may also comprise cooling water supply hoses connected to the rotary joints, and biasing units that apply force to support the hoses such that the mass of the hoses is not carried by the casting rolls. Guides may also be provided that guide the hoses in a radial direction of the casting rolls.

The twin roll type casting machine may also comprise spindles capable of transmitting rotational movement from a rotational drive to drive the casting rolls, and biasing units capable of applying a force upwards to support the spindles such that the mass of the spindles is not carried by the casting rolls. Bearings may be provided to support the spindles, and the biasing units capable of applying a force upwards to support the bearings. Guides may also be provided capable of guiding the bearings in a horizontal direction.

Also disclosed is a method of producing thin cast strip by continuous casting comprising the steps of:

(a) assembling a twin-roll caster having a pair of casting rolls laterally positioned to form a nip between said casting rolls;

(b) assembling a drive system for said twin-roll caster capable of driving said casting rolls in a counter rotational direction;

(c) assembling a metal delivery system capable of forming a casting pool supported by said casting rolls above said nip and having side dams adjacent to an end of the nip to confine said casting pool;

(d) introducing molten metal between said pair of casting rolls to form said casting pool supported on casting surfaces of said casting rolls and confined by said side dams;

(e) counter-rotating said casting rolls to form solidified metal shells on said surfaces of said casting rolls and cast strip from said solidified shells through said nip between said casting rolls; and (f) applying a thrust force through casting roll support structures on each casting roll to bias the casting rolls together, with a majority portion of the thrust force to counterbalance ferrostatic pressure.

The step of applying a thrust force may include reducing vertical loads applied on the casting roll support structures.

The step of applying the thrust force comprises introducing cooling water into rotary joints coupled to at least one end of the casting rolls, with the rotary joints capable of supplying cooling water into and removing cooling water out of passages in the casting rolls so that the flow of cooling water into and out of the rotary joints exert forces on the casting rolls generally in the direction along the rotational axis of the casting rolls. The rotary couplings may be capable of flowing the cooling water into and out of the rotary coupling in a generally vertical direction perpendicular to a rotation axis of the casting roll.

The step of introducing and removing cooling water may be performed at both ends of each casting roll. Where the step of introducing and removing cooling water is performed at one end of the casting rolls, the method may further comprise the step of counterbalancing the weight of the rotary joints by applying a counterweight at the other end of the casting rolls.

In the method of producing thin cast strip, the step of applying a thrust force may comprise applying a generally upwards force on cooling water conduits to reduce loads applied on the casting roll support structures by the cooling water conduits.

The method of producing thin cast strip may further comprise transmitting rotary movement from a drive mechanism through a spindle to a corresponding casting roll, and the step of applying a thrust force may comprise applying an upwards force on the spindle such that the mass of the spindle is generally not carried by the associated casting roll.

The twin roll casting machine and method of continuously casting thin strip may provide one or more than one of the following beneficial effects.

The inflow and the outflow of cooling water to and from the rotary joints of the casting rolls is directed generally along the axes of rotation of the casting rolls, with a result that there are reduced unbalanced rogue forces (and consequently reduced thrust forces F needed) compared to the previously known casting machine shown in FIGS. 5 and 6.

The rotary joints generate moments that act on the casting roll and about the adjacent casting roll end support structures that can be counter balanced by each other or by counterweights. In embodiments where counterweights are employed, each counterweight generates a moment that acts on the casting roll and about the adjacent casting roll support structure that are complementary to the moments of the rotary joint at the opposite ends of the casting rolls. The counterweights also assist in distributing the mass of the casting rolls between the roll end support structures when the casting rolls 1 are rotating.

When there are rotary joints at both ends of the casting rolls, upwards directed forces are applied to both ends of the casting rolls, and reduce sliding resistance of the casting roll end support structures that support the casting rolls.

Where cooling water supply hoses are provided and the cooling water hoses are supported by biasing units, the mass of the hoses is not carried by the casting rolls, and the sliding resistance of the roll end support structures that support the casting rolls are reduced.

Where bearings supporting the spindles are biased upwardly and supported to move horizontally, the mass of the spindles is not carried by the casting rolls, and the sliding resistance of the roll end support structures that support the casting rolls are reduced.

BRIEF DESCRIPTION OF THE DRAWINGS

The present invention is described further by way of example with reference to the accompanying drawings, of which.

DETAILED DESCRIPTION OF THE DRAWINGS

Figure 1:
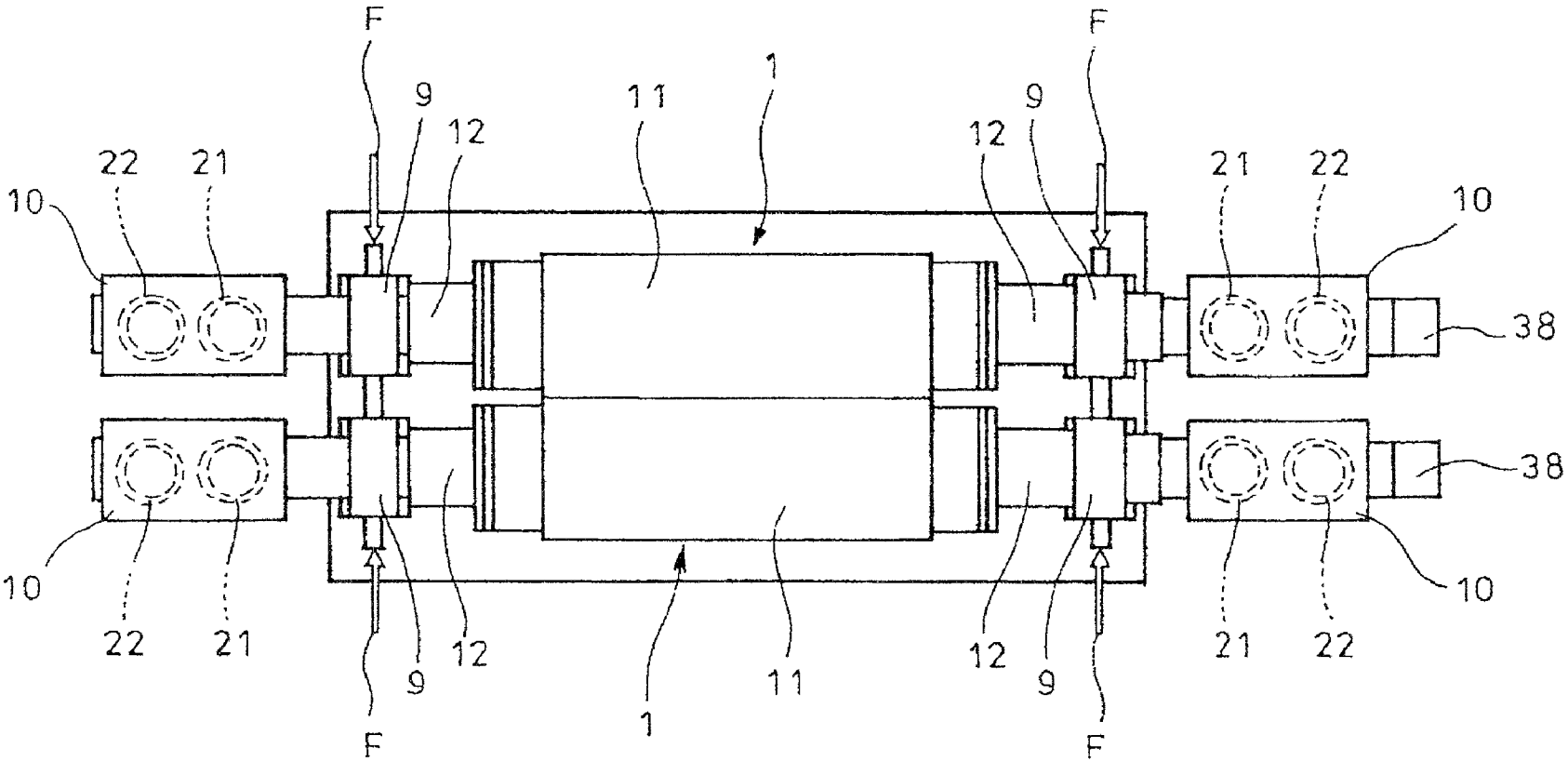
FIG. 1 is a top plan view of the casting rolls of one embodiment of a twin roll casting machine.
Figure 2:
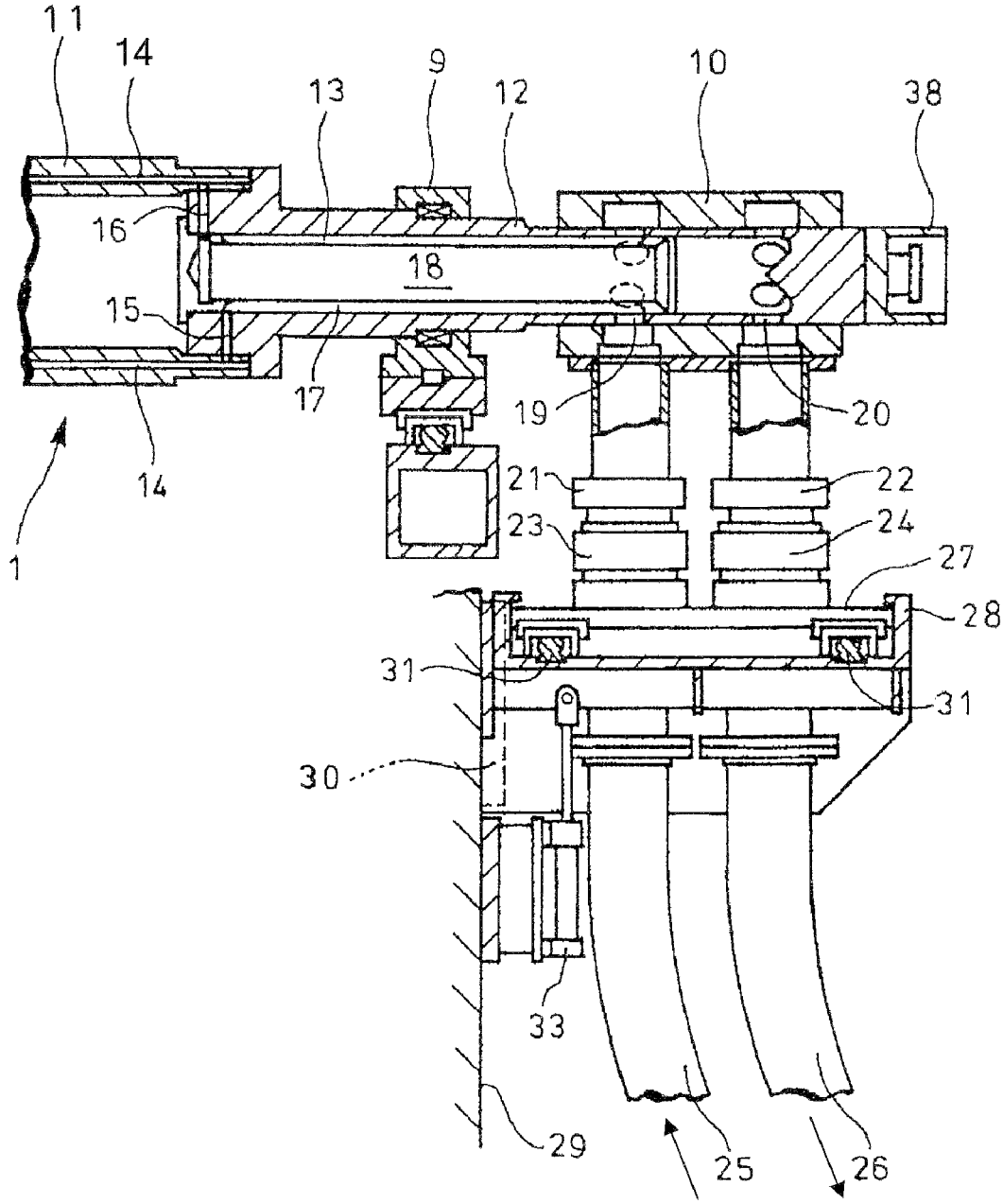
FIG. 2 is a vertical cross-sectional view of an end portion of one of the casting rolls on the right hand side of FIG. 1.
Figure 3:
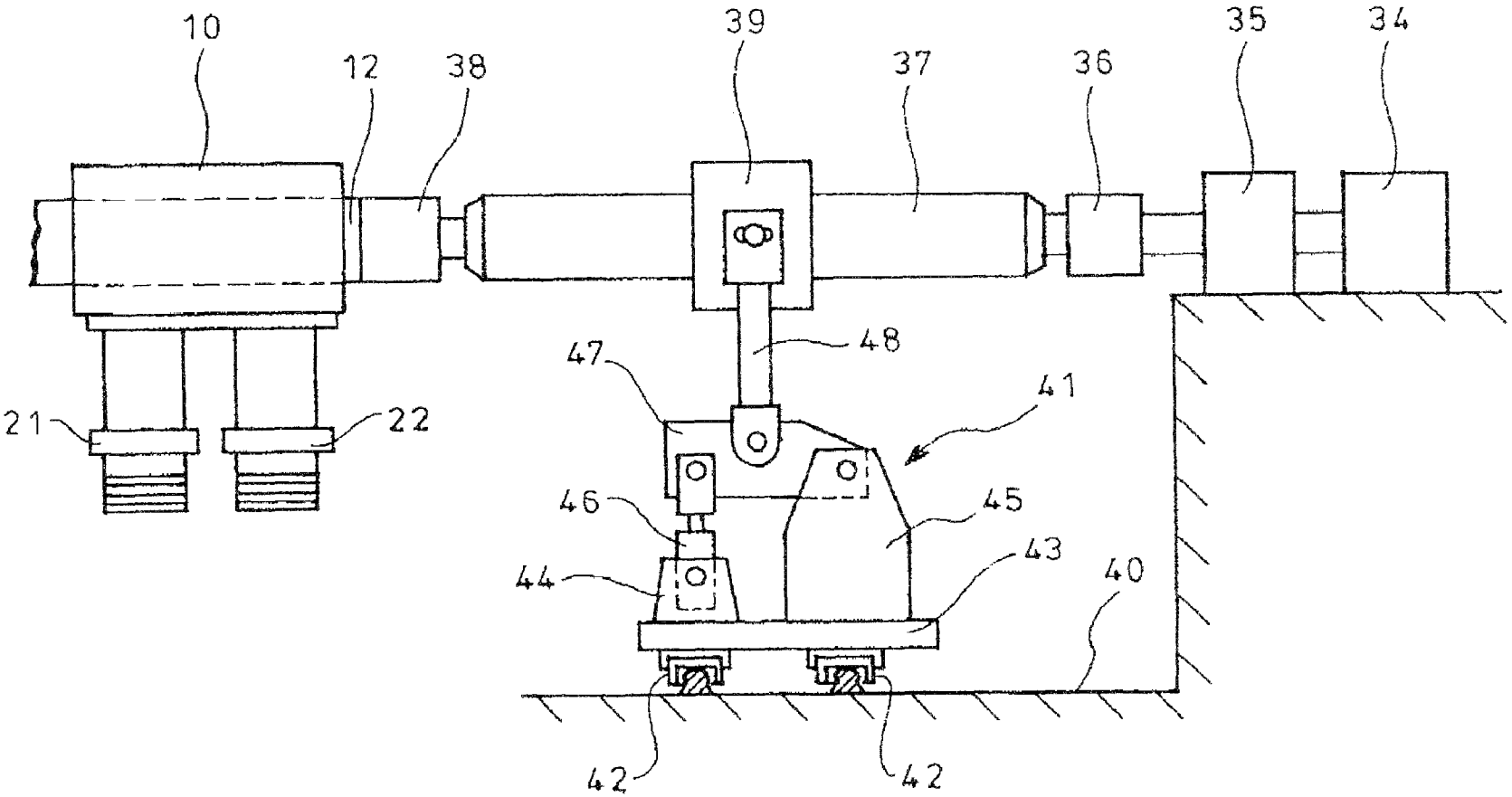
FIG. 3 is a side view of a casting roll drive system of the twin roll casting machine.

FIGS. 1 to 3 illustrate one embodiment of a twin roll casting machine and a method of casting thin cast strip.

The casting machine comprises a pair of water-cooled casting rolls 1 that are laterally positioned with a nip formed therebetween. The casting rolls 1 are forced towards each other by thrust forces F applied by biasing units (not shown) to roll end support structures 9 that support the ends of the rolls. The majority of the thrust forces applied on the casting rolls to bias the casting rolls together counterbalance the ferrostatic pressure, and apply a thrust force to reduce the vertical load applied on the casting roll support structure.

The casting machine and method also may comprise rotary joints 10 for supplying cooling water to and removing cooling water from the casting rolls 1 that are attached to the casting rolls 1 at both ends of the rolls.

Each casting roll 1 comprises a cylindrical roll body 11 and hollow stub shafts 12 that extend from the two ends of the roll bodies 11. A tubular dividing wall 13 is disposed centrally within the hollow interior of each stub shaft 12 and divides the space into an outer passage 17 and an inner cross-section passage 18.

Each casting roll 1 comprises a plurality of cooling water passages 14 disposed adjacent the casting roll surfaces and extending through the roll bodies 11 in the direction of the axis of rotation of the casting rolls.

In addition, each stub shaft 12 comprises a plurality of radial extending cooling passages 15 and 16 in the leading end of the stub shaft 12 engaging the roll body 11. The cooling passages 15 connect the outer passages 17 of the stub shafts 12 to selected cooling passages 14 in the roll bodies 11 adjacent the casting roll surfaces. The cooling passages 16 of the stub shafts 12 connect the inner passages 18 of the stub shafts 12 with the remaining cooling passages 14 in the roll bodies 11.

With particular reference to FIG. 2, end sections of the stub shafts 12 have inlets 19 for inflow of cooling water from the exterior the stub shafts 12 to the outer passages 17 in the stub shafts 12. End sections of the stub shafts 12 also have outlets 20 for outflow of cooling water from the inner passages 18 of the stub shafts 12 to the exterior of the stub shafts.

The rotary joints 10 engage the end sections of the stub shafts 12.

With further reference to FIG. 2, downwardly extending fixed couplers 21 communicate with the inlets 19, and downwardly extending fixed couplers 22 communicate with the outlets 20. The fixed couplers 21 and 22 for each casting roll 1 are positioned to extend generally vertically and perpendicular to the axis of rotation of the casting roll 1. The above-described arrangement is such that the flow of cooling water into each rotary joint 10 and the flow of cooling water out of the rotary joint 10 is in a vertical direction generally away from a rotational axis of the casting roll 1.

The positioning of the rotary joints 10 and the fixed couplers 21 and 22 to both ends of the casting rolls 1 is such that there is a more balanced distribution of the mass of these components in relation to the casting rolls 1.

In addition, the upward flow of cooling water to the rotary joints 10 applies upward forces to the casting rolls 1 and reduces sliding resistance of the roll end support structures 9.

In operation of the casting machine, cooling water may flow in a single or multiple pass path through each casting roll 1.

Specifically, in the case of a two pass path, cooling water flows from the rotary joint 10 at one end of the casting roll 1 through the outer passage 17 in one of the stub shafts 12, into and through a cooling water passage 15 in the stub shaft 12 and into and then along a cooling water passage 14 in the roll body 11, into and then along another cooling water passage 14 in the roll body 11, into and through a cooling water passage 16 of the stub shaft 12 and then into and along the inner passage 18 in the stub shaft 12 to the outlet in the rotary joint 10.

Cooling water passes through a similar process at the other end of the casting rolls 1, entering and returning via the other rotary joint 10 of the casting roll 1.

With further reference to FIG. 2, cooling water supply hoses 25 are connected to the fixed couplers 21 through movable couplers 23, and cooling water supply hoses 26 are connected to the fixed couplers 22 through movable couplers 24.

The movable couplers 23 and 24 are mounted on a single slide base 27. A lifting frame 28 is disposed below the slide base 27. The lifting frame 28 is guided vertically by a support guide bearing 30 positioned between the lifting frame 28 and a support frame 29. The slide base 27 is guided in a radial direction of the casting rolls 1 (i.e. parallel to the direction of movement of the roll end support structure 9) by a direct action guide bearing 31 that is interposed between the slide base 27 and the lifting frame 28.

Thus, the fixed couplers 21 and 22, to which the movable couplers 23 and 24 are connected, move together with the roll end support structure 9, while maintaining their positions under the casting rolls, and the inflow and the outflow of cooling water to the rotary joints 10 is maintained in a vertical direction away from a center of rotation of the associated casting roll 1. As a consequence of this arrangement, the force arising from the flow of cooling water acts in the axial direction along the axis of rotation of each casting roll 1.

With further reference to FIG. 2, a cylinder 33 is interposed as a lifting mechanism between the lifting frame 28 and the support frame 29. When the cylinder 33 is operated, the weight of the cooling water supply hoses 25, the cooling water discharge hoses 26, and the movable couplers 23 and 24 is supported by the support structure and is not carried by the casting rolls 1. Consequently, the overall mass of the casting rolls 1 is reduced and the sliding resistance of the roll end support structures 9 is also reduced.

With reference to FIG. 3, the casting machine comprises a drive motor 34 that is operatively connected to one end of each casting roll 1. The operative connection is via a gear drive 35, a universal coupling 36, a spindle 37, and a universal coupling 38. The drive motors 34 are operable to rotate the casting rolls 1.

Each spindle 37 is supported by a spindle support device 41 that is disposed on a plant support surface 40 and is coupled to the spindle 37 via a bearing 39 supporting the spindle 37 at a middle section of the spindle 37.

The spindle support device 41 comprises a slide frame 43 having a guide bearing 42. This makes it possible for the bearing 39, that pivots on the universal coupling 36 adjacent the gear drive 35, to describe a gentle arc. The spindle support device 41 also comprises brackets 44 and 45 that are juxtaposed with the slide frame 43, a cylinder 46 having a barrel pivotally mounted to the bracket 44, and a link lever 47 upon which the base end pivots on the other bracket 45 and the leading end pivots on the piston rod of the cylinder 46.

The spindle support device 41 also comprises a lift arm 48, of which the lower end part pivots on the middle portion in the lengthwise direction of the lift lever 47 and of which the upper end part pivots on the bearing 39.

When the cylinder 46 of the spindle support device 41 is caused to operate and the bearing 39 is moved upwards, the mass of the spindle 37 is supported by the spindle support device 41. Consequently, the mass of these components is not carried by the casting rolls 1 and the sliding resistance of the roll end support structures 9 is reduced.

Moreover, the bearing 39 follows the roll end support structures 9 through the action of the guide bearing 42.

In the twin roll casting machine illustrated in FIGS. 1 to 3, there is more balanced distribution of the mass of the casting rolls 1 such that the centers of the roll bodies 11 are the centers of gravity of the rolls 1, and the force generated by the flow of cooling water acts in the axial direction of the casting rolls 1. Consequently, unbalanced rogue forces and hence the thrust force F that is required for the casting rolls 1 is reduced and there is reduced sliding resistance of the roll end support structures 9. These are beneficial outcomes in terms of process control and product quality, particularly in terms of producing strip of a desired thickness.

In addition to the above, the casting machine may comprise an actuator that moves the slide base 27 along with the roll end support structures 9 and an actuator that moves the slide frame 43 along the guide bearing 42.

In addition to the above, the cylinders 33 and 46 may also be replaced by motor drive type actuators.

Figure 4:
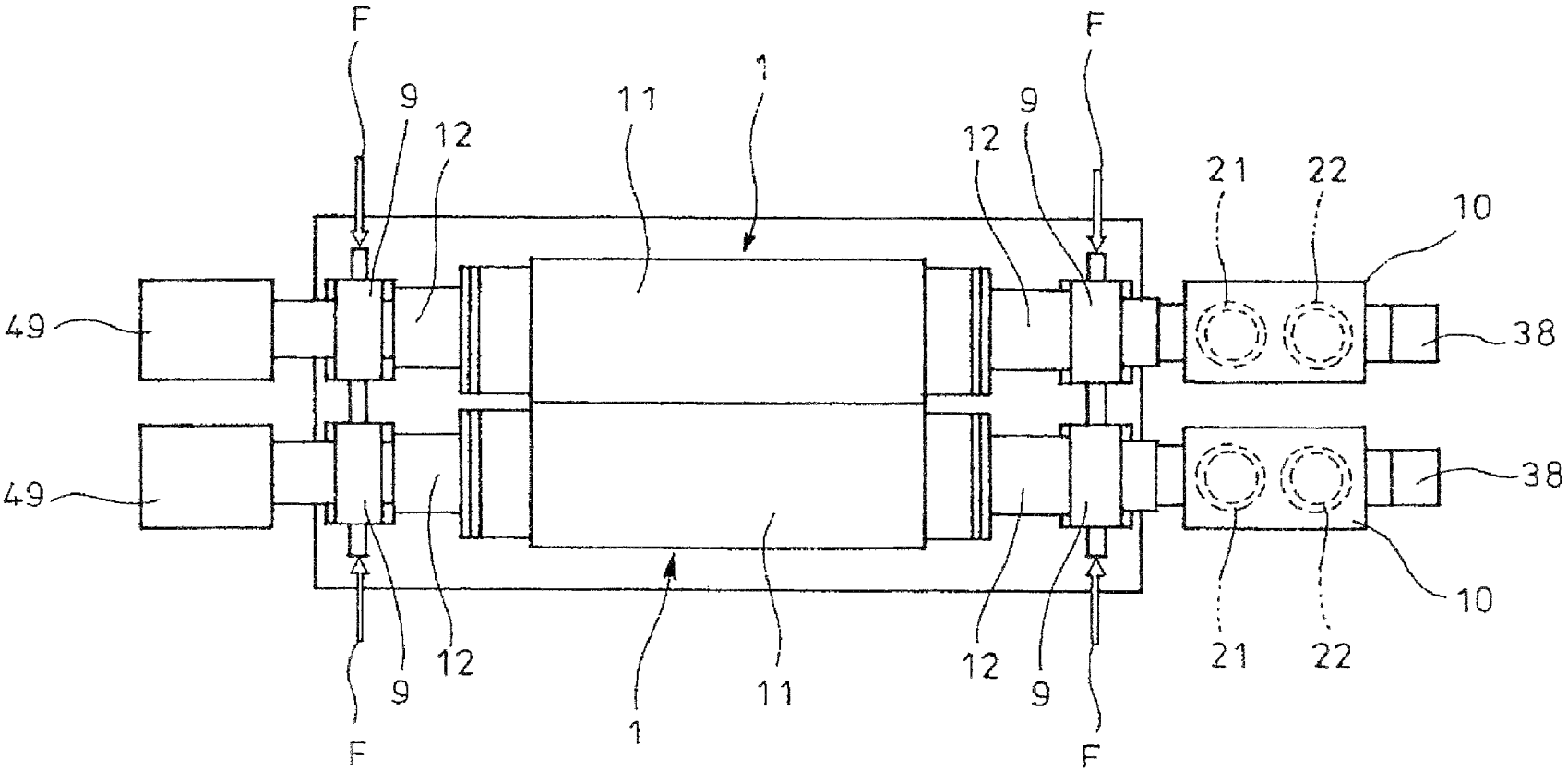
FIG. 4 is a top plan view of another embodiment of a twin roll casting machine.
Figure 5:
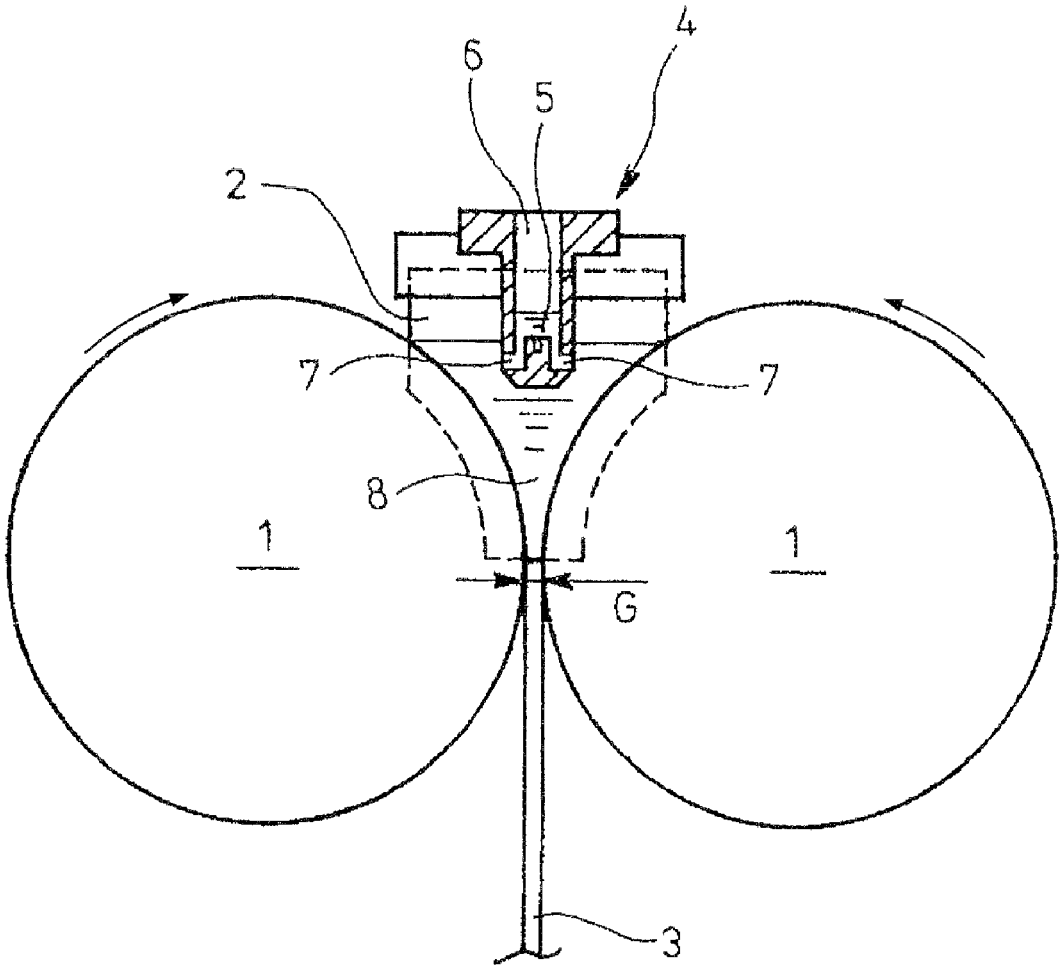
FIG. 5 PRIOR ART
FIG. 5 is a schematic drawing illustrating an example of a known twin roll casting machine viewed from the cooling roll radial direction.
Figure 6:
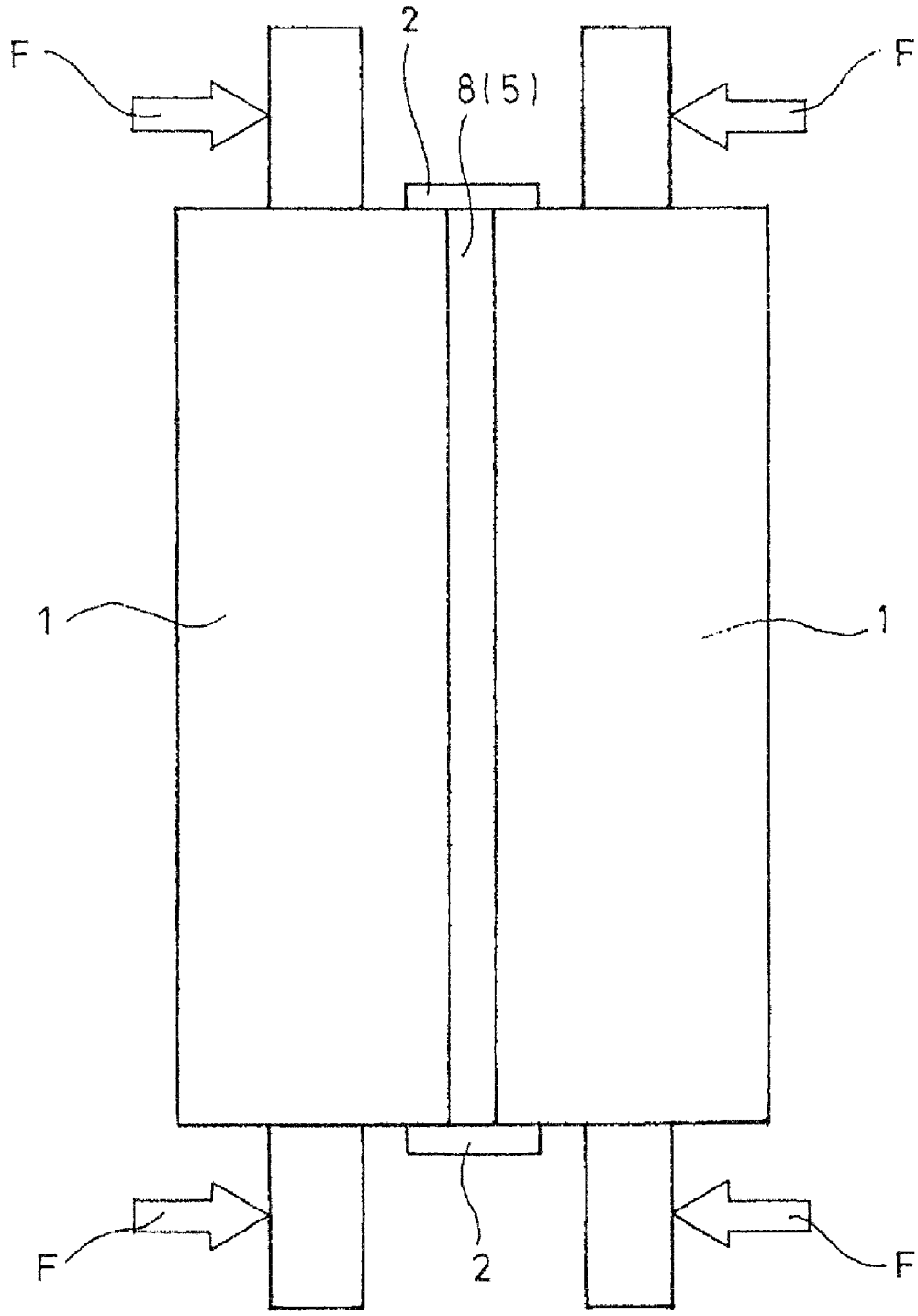
FIG. 6 PRIOR ART
FIG. 6 is a top plan view of the twin roll casting machine of FIG. 5.

FIG. 4 illustrates another embodiment of a twin roll casting machine and the method of producing thin cast strip by continuous casting, with the same reference numerals being used for the same features as shown in FIGS. 1-3.

In this twin roll casting machine and method, the rotary joints 10 are provided at one end only of the casting rolls. The casting machine may comprise a counterweight 49 on the other end of each casting roll 1 that is designed to generate a moment that is proportional to the rotary joint 10 and the fixed couplers 21 and 22.

This casting machine has the same benefits as the casting machine illustrated in FIGS. 1 to 3.

The twin roll casting machine and method of casting thin cast strip by continuous casting envisaged by the present invention is not limited to the above-described embodiments and may be modified without departing from the sprit and scope of the invention.

What is claimed is:

1. A twin roll casting machine comprising:

(a) a pair of water-cooled casting rolls laterally positioned to form a nip therebetween and counter rotatable about rotational axes thereof, with the casting rolls biased towards each other by thrust forces;

(b) rotary joints coupled to at least one end of the casting rolls and capable of supplying cooling water into and removing cooling water out of passages in the casting rolls, with the rotary joints of each casting roll being arranged so that the flow of cooling water into the rotary joints and the flow of cooling water out of the rotary joints exert forces on the casting rolls generally in the direction along the rotational axis of the casting rolls;

(c) cooling water supply hoses connected to the rotary joints; and (d) biasing units capable of supporting the hoses such that the mass of the hoses is not carried by the casting rolls.

2. A twin roll casting machine of claim 1 where the rotary joints are coupled to both ends of each casting roll.

3. A twin roll casting machine of claim 1 where the flow of cooling water into the rotary joints of each casting roll and the flow of cooling water out of the rotary joints exert forces in a vertical direction that is perpendicular to a rotational axis of the casting roll.

4. A twin roll casting machine described in claim 1 comprising in addition spindles that transmit rotary movement from a drive mechanism to the casting rolls, and biasing units capable of applying a force to support the spindles such that the mass of the spindles is generally not carried by the casting rolls.

5. The twin roll casting machine of claim 1 further comprising the cooling water flowing in a single pass path through the casting roll.

6. The twin roll casting machine of claim 1 further comprising the cooling water flowing in a multiple pass path through the casting roll.

7. A twin roll casting machine comprising:

(a) a pair of water-cooled casting rolls laterally positioned to form a nip therebetween, with the casting rolls biased towards each other by thrust forces;

(b) rotary joints coupled to sections on one end of the casting rolls and capable of supplying cooling water into and removing cooling water out of passages in the casting rolls, with the rotary joints of each casting roll being arranged so that the flow of cooling water into the rotary joints and the flow of cooling water out of the rotary joints exert forces on the casting rolls generally in a direction along the rotational axis of the casting rolls; and (c) counterweights attached at the other end of the casting rolls that counterbalance the rotary joints;

(d) cooling water supply hoses connected to the rotary joints; and (e) biasing units capable of supporting the hoses such that the mass of the hoses is not carried by the casting rolls.

8. The twin roll casting machine as claimed in claim 7, where the flow of cooling water into and out of the rotary joints is in a vertical direction that is perpendicular to a rotational axis of the casting roll.

9. A twin roll casting machine described in claim 7 comprising in addition guides capable of guiding the hoses in a radial direction of the casting rolls.

10. A twin roll casting machine described in claim 7 where the biasing unit is capable of applying a force vertically upwards on the hoses.

11. A twin roll casting machine described in claim 9 where the biasing unit is capable of applying a force vertically upwards on the hoses.

12. A twin roll casting machine described in claim 7 comprising in addition spindles that transmit rotary movement from a drive mechanism to the casting rolls, and biasing units capable of applying a force to support the spindles such that the mass of the spindles is generally not carried by the casting rolls.

13. The twin roll casting machine described in claim 12 comprising in addition bearings that support the spindles, and where the biasing unit is capable of supporting the bearings.

14. The twin roll casting machine described in claim 13 comprising in addition guides for guiding the bearings in a generally horizontal direction.

15. The twin roll casting machine as claimed in claim 7, further comprising;

the cooling water flowing in a single pass path through the casting roll.

16. The twin roll casting machine as claimed in claim 7, further comprising;

the cooling water flowing in a multiple pass path through the casting roll.

17. A twin roll casting machine comprising:

(a) a pair of water-cooled casting rolls positioned laterally to form a nip therebetween, with the casting rolls biased towards each other by thrust forces acting;

(b) rotary joints coupled to the casting rolls at opposite ends of the casting rolls and capable of supplying cooling water into and removing cooling water out of the casting rolls; and (c) cooling water supply hoses connected to the rotary joints, with biasing units capable of applying a force to support the hoses such that the mass of the hoses is not carried by the casting rolls.

18. The twin roll casting machine as claimed in claim 17 where the biasing unit applies force generally vertically upwards on the hose.

19. The twin roll casting machine as described in claim 17 further comprising guides capable of guiding the hoses in a radial direction of the casting rolls.

20. The twin roll casting machine as described in claim 18 further comprising guides capable of guiding the hoses in a radial direction of the casting rolls.

21. The twin roll casting machine as claimed in claim 17, adapted for the cooling water to flow in a single pass path through the casting roll.

22. The twin roll casting machine as claimed in claim 17, adapted for the cooling water to flow in a multiple pass path through the casting roll.

23. A twin roll casting machine comprising:

(a) a pair of water-cooled casting rolls laterally positioned to form a nip therebetween, the casting rolls biased towards each other; and (b) spindles transmitting rotary movement from a drive mechanism to the casting rolls, and biasing units capable of supporting the spindles such that the mass of the spindles is not carried by the casting rolls;

(c) bearings capable of supporting the spindles, and the biasing units in addition capable of supporting the bearing; and (d) guides capable of guiding the bearings in a generally horizontal direction.

24. A method of producing thin cast strip by continuous casting, said method comprising:

(a) assembling a twin-roll caster having a pair of casting rolls laterally positioned to form a nip between said casting rolls;

(b) assembling a drive system for said twin-roll caster capable of driving said casting rolls in a counter rotational direction;

(c) assembling a metal delivery system capable of forming a casting pool supported by said casting rolls above said nip and having side dams adjacent to an end of the nip to confine said casting pool;

(d) introducing molten metal between said pair of casting rolls to form said casting pool supported on casting surfaces of said casting rolls and confined by said side dams;

(e) counter-rotating said casting rolls to form solidified metal shells on said surfaces of said casting rolls and cast strip from said solidified shells through said nip between said casting rolls; and (f) applying a thrust force through casting roll support structures on each casting roll to bias the casting rolls together, with a majority portion of the thrust force to counterbalance ferrostatic pressure, and applying a generally upwards force on cooling water conduits to reduce loads applied on the casting roll support structures by the cooling water conduits.

25. The method of producing thin cast strip of claim 24, where the step of applying a thrust force includes applying at least an upward force reducing vertical loads applied on the casting roll support structures.

26. The method as claimed in claim 24 where the step of applying the thrust force comprises:

(g) introducing cooling water into rotary joints coupled to at least one end of the casting rolls, with the rotary joints capable of supplying cooling water into and removing cooling water out of passages in the casting rolls so that the flow of cooling water into and out of the rotary joints exert forces on the casting rolls generally in the direction along the rotational axis of the casting rolls.

27. The method as claimed in claim 26 where rotary couplings are capable of flowing the cooling water into and out of the coupling in a generally vertical direction perpendicular to a rotation axis of the casting roll.

28. The method of producing thin cast strip of claim 26, where the step of introducing and removing cooling water is performed at both ends of each casting roll.

29. The method of producing thin cast strip of claim 26, where the step of introducing and removing cooling water is performed at one end of the casting rolls, and further comprising the step of counterbalancing the weight of the rotary joints by applying a counterweight at the other end of the casting rolls.

30. The method of producing thin cast strip of claim 26, further comprising:

(h) transmitting rotary movement from a drive mechanism through a spindle to a corresponding casting roll, and (i) the step of applying a thrust force comprises applying an upwards force on the spindle such that the mass of the spindle is generally not carried by the associated casting roll.

31. The method of producing thin cast strip of claim 27, where the step of introducing and removing cooling water is performed at one end of the casting rolls, and further comprising the step of counterbalancing the weight of the rotary joints by applying a counterweight at the other end of the casting rolls.

32. The method of producing thin cast strip of claim 24, where the step of applying a thrust force comprises applying a generally upwards force on cooling water conduits to reduce loads applied on the casting roll support structures by the cooling water conduits.

33. The method of producing thin cast strip of claim 24, further comprising:

(h) transmitting rotary movement from a drive mechanism through a spindle to a corresponding casting roll; and (i) the step of applying a thrust force comprises applying an upwards force on the spindle such that the mass of the spindle is generally not carried by the associated casting roll.

34. The method as claimed in claim 26, further comprising:

(h) directing the flow of cooling water in a single pass path through the casting rolls.

35. The method as claimed in claim 26, further comprising:

(h) directing the flow of cooling water in a multiple pass path through the casting rolls.

* * * * *